United States Patent [19]

Hawelka et al.

[11] Patent Number: 4,830,421

[45] Date of Patent: May 16, 1989

[54] SERVICE VEHICLES

[75] Inventors: Walter Hawelka, Linz/Donau; Hermann Staudinger, Neuhofen, both of Austria

[73] Assignee: Konrad Rosenbauer KG, Leonding, Austria

[21] Appl. No.: 112,055

[22] Filed: Oct. 22, 1987

Related U.S. Application Data

[63] Continuation of Ser. No. 42,592, Apr. 17, 1987, abandoned, Continuation of Ser. No. 733,520, May 13, 1985, abandoned.

[30] Foreign Application Priority Data

May 18, 1984 [AT] Austria ..... 1645/84

[51] Int. Cl.[4] ..... A62C 27/20

[52] U.S. Cl. ..... 296/24.1; 296/37.6; 296/183; 280/5 D; 312/238; 239/172; 169/24

[58] Field of Search ..... 296/3, 24 R, 37.6, 183, 296/193–197; 280/4, 5 R, 5 D; 312/202, 238; 169/24; 239/172

[56] References Cited

U.S. PATENT DOCUMENTS

| | | | |
|---|---|---|---|
| 1,970,955 | 8/1934 | Ehrlich | 296/24 R |
| 2,533,772 | 12/1950 | De Frees | 280/4 |
| 2,574,483 | 11/1951 | Jack | 296/3 |
| 2,978,153 | 4/1967 | Brindle | 296/37.6 |
| 3,633,970 | 1/1972 | Langhais | 296/24 R |
| 3,770,060 | 11/1973 | Forsyth et al. | 169/24 |
| 4,126,349 | 11/1978 | Nelson et al. | 224/42.42 X |
| 4,146,280 | 3/1979 | Crownhart | 312/238 |
| 4,469,364 | 9/1984 | Rafi-Zadeh | 296/24 R |
| 4,678,041 | 7/1987 | Staudinger | 296/37.6 X |

FOREIGN PATENT DOCUMENTS

| | | | |
|---|---|---|---|
| 120355 | 9/1945 | Australia | 169/24 |
| 125234 | 11/1984 | European Pat. Off. | 169/24 |
| 610205 | 4/1979 | Switzerland | 169/24 |

*Primary Examiner*—Dennis H. Pedder
*Attorney, Agent, or Firm*—Kurt Kelman

[57] ABSTRACT

A service vehicle comprises a chassis frame, a driver's cab and two side walls defining an equipment compartment on the chassis frame. The equipment compartment comprises equipment modules mounted in the range of each one of the side walls and holding service equipment, and the equipment modules may be guidingly displaced with respect to the vehicle for ready access thereto.

9 Claims, 7 Drawing Sheets

SERVICE VEHICLES

CROSS-REFERENCE TO RELATED APPLICATION

This is a continuation of our copending U.S. application Ser. No. 733,520, filed May 13, 1985, now abandoned and replaced by continuation Ser. No. 42,592, filed Apr. 17, 1987, now abandoned.

BACKGROUND OF THE INVENTION

1. Field of the Invention

The invention relates to a service vehicle, in particular but not exclusively to a fire service vehicle, having a driver's cab and an equipment compartment installed on a chassis frame, the equipment compartment being adapted for reception of implements and/or fire-fighting devices and the like.

2. Description of the Prior Art

Service vehicles known at present comprise an equipment cabin which commonly includes shelves and drawers for receiving the different items of equipment. In this connection, it is also known to install some equipment elements, such as fire extinguisher pumps, on pivotable inserted parts so that they may rapidly be moved from the level of the loading area of the service vehicle to the roadway surface. Different vehicles for different kinds of equipment mostly require a different detailed layout of the equipment cabin for each of the service vehicles and this requires a considerable investment.

Standard commercial vehicles, on which appropriate modular equipment holders are installed have also been used as service vehicles. Such vehicles are being produced and sold at present by the assignee of applicants under the name "The Cobra Universal Vehicle". They have also equiped service of fire service vehicles of conventional structure with crane containers to outfit them for special applications, for example the application of oil or foam, forest fires, earthquakes and the like. The containers prepared in this manner are loaded by crane on the vehicle and carried to the site of operation. In the case of sites of operation situated off the road, these containers may also be carried by aircraft, in particular helicopters. These known service vehicles have proved satisfactory but they could not be adapted to varying emergency requirements.

OBJECTS AND SUMMARY OF THE INVENTION

An object of the invention is to provide a service vehicle and in particular a fire service vehicle which may be provided with a standard superstructure as regards the driver's cab and the equipment compartment, and which may be fitted out rapidly and economically with the items of equipment needed for different requirements.

This problem of the invention is solved with equipment modules for the reception of implements and/or fire extinguishing means, which are displaceable with respect to the vehicle. Standard equipment modules for this purpose may be produced in advance and provided with different items of equipment, depending on the purpose of application. Such equipment modules may thus be prefabricated and fitted out quite independently of the manufacture of the service vehicles. Upon ordering the vehicle, the customer may select the modules appropriate to this vehicle from the available equipment modules. These may also be simply exchanged at any time and replaced by an equipment module of a different series, if the vehicle is subsequently to receive complementary equipment or to be re-equipped. As a result, constructional work required to provide different vehicles is reduced and the service vehicles have an approximately identical fundamental structure.

According to one feature of the invention, the equipment module may comprise a cylindrical casing having a circular cross-section and a longitudinal axis arranged at right angles to the wheel support plane of the service vehicle as a pivot shaft. The pivot shaft may be installed in a bearer frame and the equipment module may be pivoted outwards beyond the lateral boundary of the vehicle, so that the equipment may simply be taken out by a fireman, and the fire service personnel do not impede each other upon removing the items of equipment. Thus, access is facilitated to the items of equipment stowed in the equipment modules.

Furthermore, it is possible for the shaft to be placed at an approximate distance from a side of the service vehicle which corresponds to a radius of the circle forming the cross-sectional shape of the equipment module. The radius preferably corresponds to half the distance between the two opposed sides, thereby assuring satisfactory access to the rotatably or pivotally mounted cylindrical equipment modules. Furthermore, the equipment modules may be closed by roll-top covers or the like which are installed in the sidewalls of the vehicle.

It is advantageous if a diameter of the circle forming the cross-sectional shape of the equipment module corresponds to say half the distance between the two opposed sides of the service vehicle, and two equipment modules are preferably placed side-by-side transversely of the direction of travel of the service vehicle, their central longitudinal axis being situated in a common plane extending at right angles to the direction of travel. Consequently, items of equipment may be taken out at both sides of the service vehicle by the personnel, independently of each other.

It is also possible to provide equipment modules having a dimension transversely to the direction of travel which is smaller than half the distance between the opposite sides of the service vehicle, and for a driving engine for the service vehicle to be situated between the two equipment modules. This allows each of the modules to be exposed at the two opposite sides and for the space between the modules to be used satisfactorily by accommodating the assemblies installed between them.

In accordance with the invention it is also possible for the equipment module to have a cross-section in the form of a circular segment and to be closed off by a cover plate in the area of a chord delimiting the circular segment and for shelf members of similar circular segment shaped form to be provided along a central longitudinal axis of the module. Because the equipment module is provided with a cover plate, it may be utilised for sealing off the inside of the vehicle during the travel of the vehicle, which obviates the need for additional hinged panels, doors or roller blinds.

In an advantageous arrangement, the central longitudinal axis is situated at an approximate distance from a side of the service vehicle which corresponds to the difference between the height of the arc and the radius of the circular segment forming the cross-sectional shape of the equipment module, whereby the lost internal volume of the vehicle is minimised. At the same time, the construction of the equipment module in the form of a circular segment increases the area over which access may be gained to the stored equipment, the area being proportional to the arcuate periphery of the equipment modules, which is longer for example than the length of a sidewall measured in the longitudinal direction of the vehicle.

According to another embodiment of the invention, the equipment modules have a cross-section at right angles to their central longitudinal axis which corresponds to a circular segment whose arc height is greater than its radius, thereby securing more rapid access to the items of equipment since the opening of the equipment modules requires a lesser angle of pivotal displacement.

According to another embodiment of the invention, a carrying frame for the equipment modules is fastened on an extinguisher fluid tank which is self-supporting and is arranged approximately centrally with respect to the longitudinal axis of the vehicle and is fastened by resilient connecting means such as spring elements, to the chassis frame. Cylindrical recesses are provided in the sidewall of the extinguisher fluid tank which form a cylindrical segment whose radius is greater than the radius of the equipment module. This eliminates the construction of fastening points for the equipment modules on the chassis frame, and the suspension points of the equipment modules are identical with the extinguisher fluid tanks constructed in correspondingly identical manner. In the case of different vehicle chassis frames, only three fastening points of the extinguisher fluid tank need be adapted to the vehicle body construction according to directives of the vehicle chassis manufacturer, and it is possible to manage with minor construction tasks.

It is also possible to provide an equipment module provided in the driver's cab in the area behind the driver's seat, so that the inside of the driver's cab may also be re-equipped rapidly for carrying items of equipment.

According to another embodiment of the invention, the equipment modules and/or their carrying frame and/or an intermediate frame are vertically displaceable with respect to the vehicle, so that the manifold advantages of the standardised equipment modules may be simply adapted to different uses by providing even easier access. Furthermore, this vertical displacement may facilitate access to items of equipment, assemblies or the like, e.g. the driving engine, which are situated behind the equipment modules.

In an advantageous arrangement, the central longitudinal axis of the equipment modules may extend approximately parallel to the longitudinal axis of the vehicle, and the force of gravity may be used to assist the pivotal displacement by appropriate loading of the equipment modules.

Another advantageous embodiment of the invention provides that at least a part of a bearer frame of an equipment module is mounted in laterally and/or vertically displaceable manner on the chassis frame or on the extinguisher fluid tank, for example by a parallelogram linkage of levers, and that a remotely controlled displacement drive is installed therebetween. The use of a simple and light-weight mechanism will assure a gentle and smooth displacement of the equipment module with respect to the extinguisher fluid tank or the vehicle chassis.

In another advantageous embodiment, an equipment module is of parallelepipedal shape and is preferably situated in a plane extending obliquely to the longitudinal axis of the vehicle and at right angles to the wheel support plane to provide room for opening a sliding door panel externally closing the equipment modules upon slight pivoting thereof. With this arrangement it is possible to open the equipment modules without projecting door components or without obstruction by the doors.

It is also possible for the equipment module to be pivotable with respect to the chassis frame around an axis extending in a plane at right angles to the wheel support plane and parallel to the direction of travel. The equipment modules in the region of the sides of the service vehicle may be swung away by pivoting the equipment modules around a vertical or horizontal axis, thus facilitating access to the equipment modules situated behind the former, or to a driving engine situated between equipment modules at opposite sides of the vehicle. In this connection, it is advantageous if the pivotal displacement is assisted by pivoting drives, for example hydraulic piston-cylinder device, rotary motors or by pneumatic springs biassed in the opening direction.

In another advantageous arrangement, the horizontal axis of a module extending parallel to the direction of travel is situated inwardly of a side of the vehicle and spaced from the chassis frame, allowing the equipment module to be pivoted away in upward direction without requiring complex mechanisms.

In another advantageous arrangement, two equipment modules of parallelepipedal cross-section are pivotally mounted on a common vertical axis disposed adjacent a rear corner of the vehicle such that, in a closed condition, one of the modules extends along a side and the other along a rear of the vehicle about an engine compartment and, when pivoted outwardly from the vehicle, they expose the engine compartment at the end and side of the vehicle for access. As a result the parts of the chassis frame below the pivoted equipment modules may be utilised as a supporting surface for servicing the driving engine or the auxiliary assemblies situated thereat, with restricting the headroom of the service personnel.

Another embodiment of the invention provides an equipment module installed in a vertical guiding device of a pivoted frame, the frame being rotatably mounted on a pivot shaft supported in a carrying frame which is arranged for transverse displacement relative to the longitudinal axis of the vehicle. The equipment modules may thereby simply be withdrawn sideways and set down beside the vehicle, either to facilitate exchanging the equipment modules or for setting them down or picking them up.

In accordance with the invention, it is advantageous for an equipment module to be connected to a carrying frame by readily releasable connecting elements. This renders it possible to remove or insert or exchange equipment modules within a short period.

According to another aspect, the invention includes a service vehicle associated with a module repositioning system which comprises an equipment module magazine and conveyor for reception of several equipment modules, the equipment modules thereby being rapidly and simply exchangeable while the vehicles are in operation. For example, the service vehicles of a second operational group may thereby be re-equipped to comply with special requirements at the site of operation, and it is unnecessary to keep a stock of special vehicles for particular cases of application.

Suitably, the module repositioning system is connected to a remote control device incorporating control elements disposed remote from the vehicle and the module repositioning system, for example at operational headquarters, so that the service vehicles may be simply equipped with the equipment modules of the corresponding method of operation during the period available between alerting the service personnel and the departure of the service vehicles.

BRIEF DESCRIPTION OF THE DRAWINGS

The invention will now be described, by way of example, with reference to the accompanying partly diagrammatic drawings, in which.

DETAILED DESCRIPTION OF PREFERRED EMBODIMENTS

Figure 1:
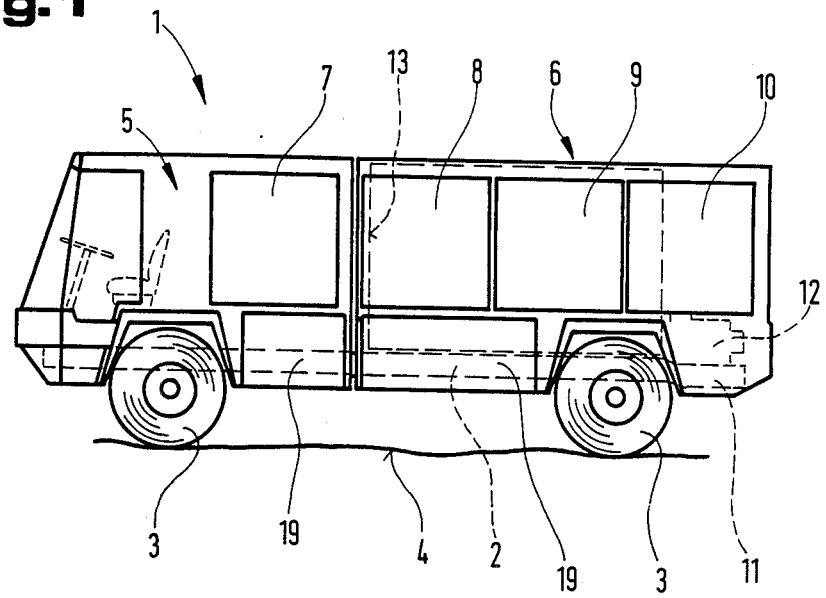
FIG. 1 is a side elevation of a service vehicle according to the invention, with equipment modules mounted in the driver's cab and in an equipment compartment.

The service vehicle 1 of FIG. 1 is a fire service vehicle having a chassis frame 2 carried by wheels 3 on a wheel support surface 4, such as a road surface. The chassis frame 2 bears a driver's cab 5 and an equipment compartment 6. An equipment module 7 is installed in the driver's cab 5 behind forward seats, and further equipment modules 8, 9 and 10 are situated in the equipment compartment 6. An extinguisher fluid pump 12 is disposed below the rearmost equipment module 10 on a part 11 of the chassis frame 2 which is displaced downwardly with respect to the chassis frame portion extending between the wheels, towards the wheel support surface 4. An extinguisher fluid tank 13 indicated in broken lines is disposed between the rows of equipment modules 8, 9 and 10 which are arranged along opposite sides of the vehicle 1.

Figure 2:
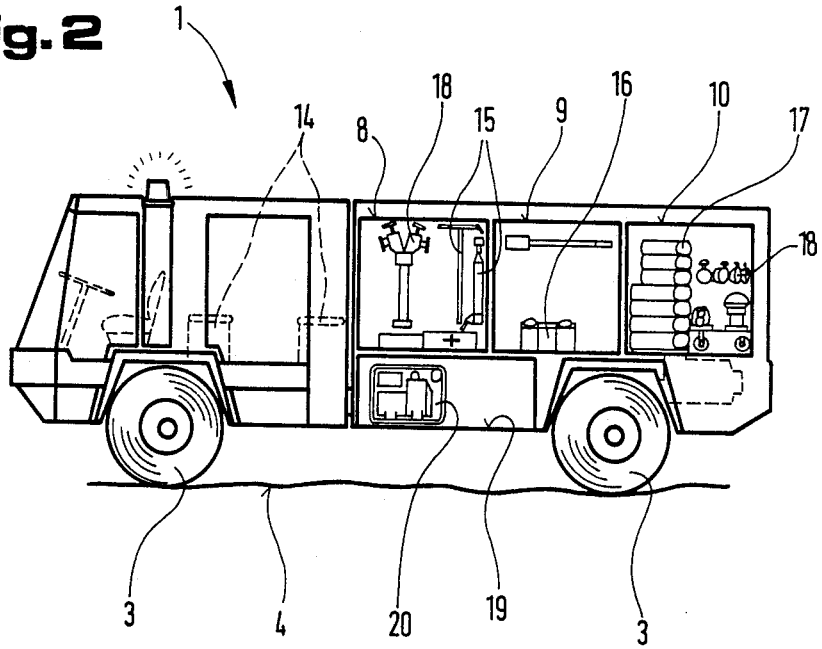
FIG. 2 is a side elevation of a service vehicle according to the invention, with equipment modules mounted in an equipment compartment.

The embodiment of FIG. 2 differs from that of FIG. 1 in that further seats 14 for personnel are installed behind the forward seats in the driver's cab in place of the equipment module 7. Like reference numerals are used in FIGS. 1 and 2 for like parts. FIG. 2 shows the equipment modules open, exposing implements 15, canisters 16 of extinguisher fluids, hoses 17 and hose fittings 18, stowed in compartments 8, 9 and 10. Below the equipment modules 8, 9 and beside the chassis frame 2 are disposed implement compartments 19 wherein, for example, there may be stowed a standby generator set 20 or other auxiliary drives for equipment, e.g. hydraulic systems or lifesaving, protective and rescue devices. It is equally possible to accommodate suction hoses for the extinguisher fluid pump 12 or for portable extinguisher fluid pumps in the section 19.

Figure 3:
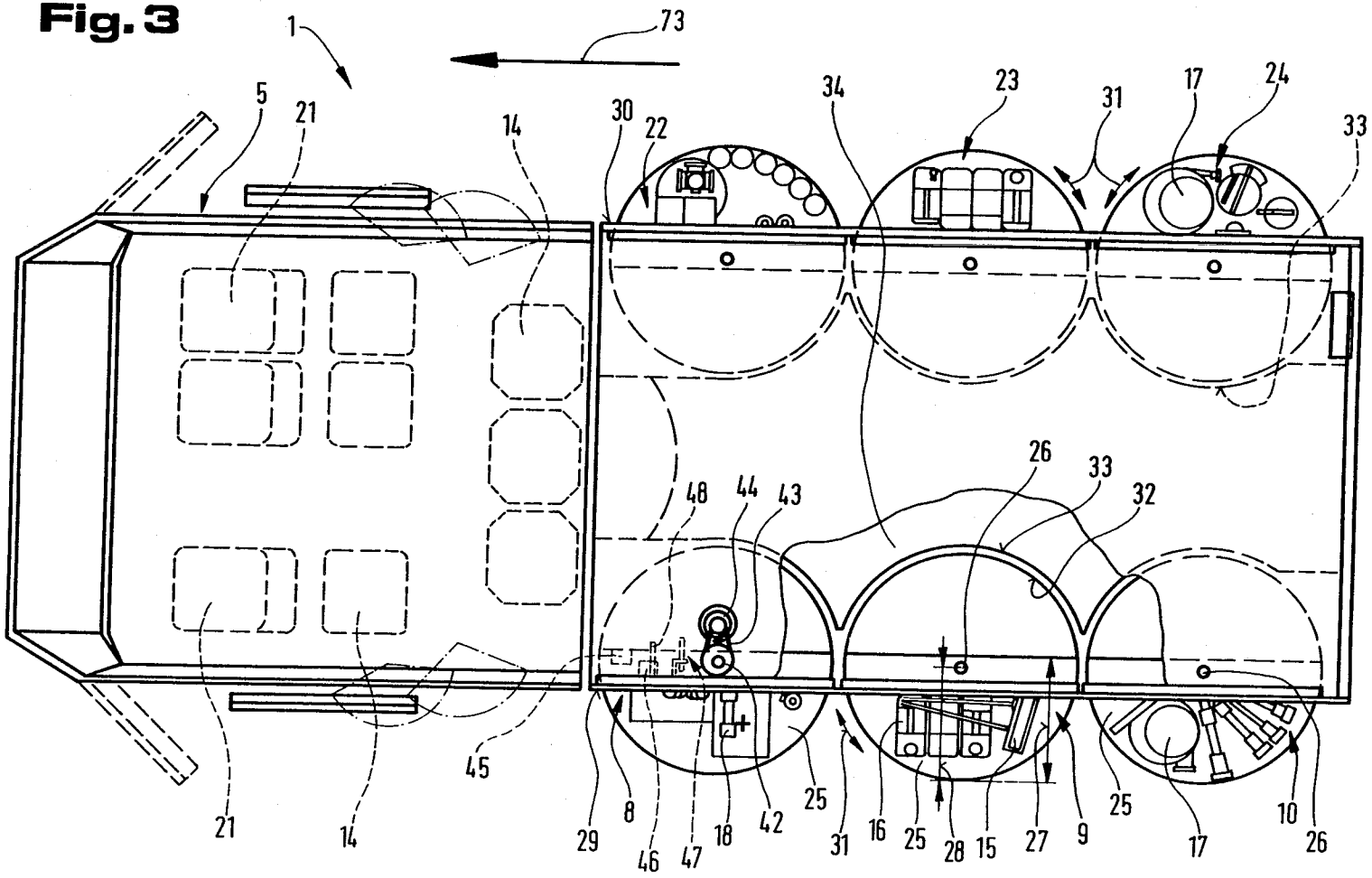
FIG. 3 is a plan view, partly cut away, of the service vehicle of FIG. 2.

As apparent from FIG. 3, two rows of further seats 14 are provided in the driver's cab 5 behind the front seats 21 for the accommodation of support personnel.

The equipment modules 8, 9, 10, 22, 23, 24 are arranged in rows on opposite sides of the vehicle and each has a cylindrical casing 25 which may be turned about a central axis 26 extending substantially perpendicularly in relation to the wheel support surface 4. The cylindrical casings form a circular segment as seen in plan view, whose arc height 27 is greater than the radius 28. The casings are shown in their outward or unloading positions in FIG. 3, in which implements 15, extinguisher means 16, hoses 17 and hose fittings 18 are disposed laterally outwards of side walls 29,30 of the equipment compartment 6 of the vehicle to facilitate access by service personnel from outside the vehicle. By pivotal displacement of the casings 25 of the modules 8 to 10 and 22 to 24 in either direction of rotation about the axes 26, as indicated by arrows 31, the arcuate segments of the casings 25 may be pivoted into complementary reception areas 32 within the vehicle. The reception areas 32 are suitably confined by complementary arcuate walls 33 of the extinguisher fluid tank 34 situated within the vehicle between the rows of modules 8–10 and 22–24.

Figure 4:
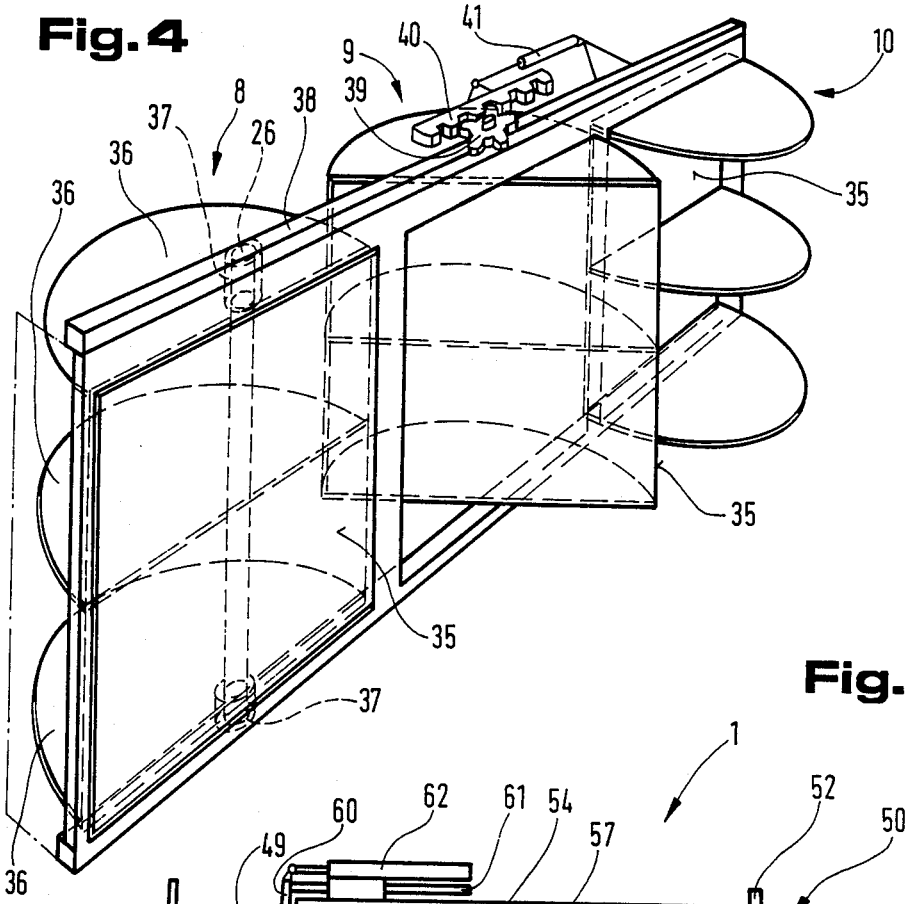
FIG. 4 is a perspective view of a side part of the equipment compartment of the vehicle of FIGS. 2 and 3, with equipment modules in different positions in a carrying frame.

As clearly seen in FIG. 4, the modules 8 to 10 are closed off at their flat sides by a cover plate 35 extending parallel to the axis 26 forming a pivot shaft. The arcuate side of the module houses three parallel shelf members 36 spaced vertically and extending normally from the plate 35. The pivot shafts 26 of the modules are journalled in bearings 37, above and below the modules, the bearings being supported in transverse members of a rectangular carrying frame 38 within which a row of modules 8–10 is mounted. For displacement of the modules about their axes 26, the pivot shafts have driving pinions 39 at their upper ends, as shown for the module 9, the pinions 39 cooperating with a driving rack 40 extending longitudinally of the row of modules and displaceably mounted on the frame 38 for reciprocation by a piston and cylinder device 41. By operation of the piston and cylinder device 41 to drive the rack 40, the modules may be pivoted between an idle position in which the cover plates 35 are at the outside of the vehicle and the module shelves 36 are within the confines 32,33, and an operational position in which the shelves 36 extend outwardly of the vehicle sides, as shown in FIG. 3. It is also possible, as shown diagrammatically for module 8 in FIG. 3, to couple the pivot shafts 26 with a Vee pulley 42 and Vee belt 43 to a respective electric motor by a slip clutch so that the modules may be driven between stops 45, 46 delimiting the operational and idle positions of the modules. Detent means are suitably provided for securing the module at either of the two positions. For example, releasable hooks or pins 47 are suitably provided at the stops 45,46 for this purpose. Chain drives may equally well be used and suitably the Vee belt or chain drives are suitably coupled to means outside the vehicle for manual actuation by a hand wheel instead of by the motor. Means may be provided to assist the opening and/or closing actions, such as pneumatic springs or like accumulator devices.

Monitoring elements 48, such as electromagnetic proximity switches, are allocated to the stops 45,46 or to the securing means 47 so that the position of the modules may be monitored. The monitoring devices may be coupled to warning systems actuated when the vehicle drive is engaged to alert the driver if the modules are not appropriately positioned or secured.

It is to be understood that other driving devices and arrangements, or other securing means and stop arrangements may equally be used.

Suitably, the actuation of the driving devices and monitoring elements may be performed from the driver's cab; for example, from the driver's seat by the driver and also at other optional points particularly outside the vehicle by suitably positioned press-button switches or the like.

Figure 5:
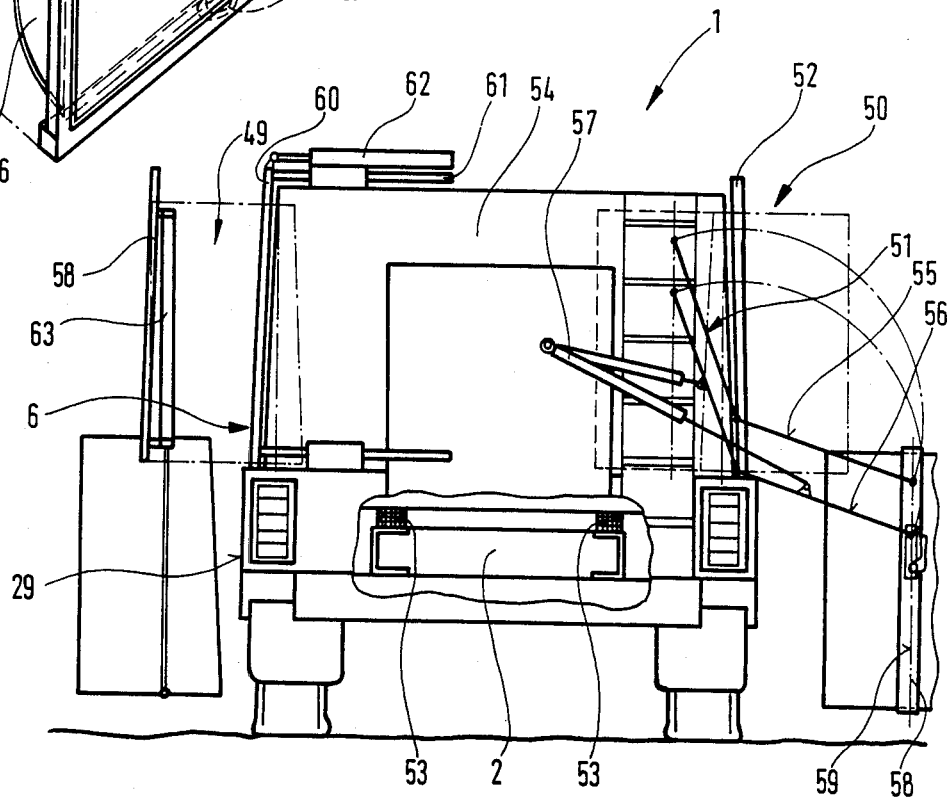
FIG. 5 is a partly sectional end elevation of an equipment module mounted for lateral and vertical displacement in relation to a service vehicle chassis by means of a parallelogram linkage of levers.

FIG. 5 shows a different embodiment of equipment modules 49,50 which are arranged to be laterally and/or vertically displaceable with respect to the chassis frame 2 of the fire service vehicle 1. To this end, the module 50 is installed by a parallelogram linkage of levers 51 in a carrying frame 52 of the vehicle body or equipment compartment containing an extinguisher fluid tank 54 supported on the chassis frame 2 by spring elements 53. Two parallel longer levers 55,56 of the linkage 51 at ends extending towards the chassis 2 are pivotally mounted on carrying frame 52 and at their other ends are pivotally secured to the equipment module 50. The module 50 is arranged to be displaced from an idle or stowed position shown in broken lines to a lowered or operational position shown in full lines by a piston and cylinder displacement drive 57 secured at one end to the tank 54 or on a frame member of the vehicle. The module 50 comprises a frame 58 to which the levers 55,56 are pivotally connected, and within which the module 50 is pivotally supported for movement about an upright axis 59 generally in the manner of the previous embodiment. As apparent from FIG. 5 at the left-hand side, a module may have cover plates which extend obliquely to the pivotal axis 59 and it will be appreciated that the sides may be of bent or curved configuration to assume an extension of the internal contour of the vehicle body when in the idle or stowed condition. This applies equally to the modules of the previous embodiments. As shown at the left-hand of FIG. 5, the hinged frame 58 or a carrying frame 60 may be extended beyond a side 29 of the vehicle into a laterally extended position shown in dash dotted lines by means of a displacement drive 62 on a guiding column 61 whereby the equipment module 49 may be displaced laterally from the vehicle. The module 49, or the frame 58 thereof, is arranged to be lowered with respect to the carrying frame 60 by means of a vertical displacement drive 63 and suitable guide rails and rollers or telescoping guide devices to the lower position shown in full lines. In a similar manner, it is possible to arrange for displacement of the equipment module also longitudinally of the vehicle in a guiding device prior to lowering the module to the wheel support surface.

Figure 6:
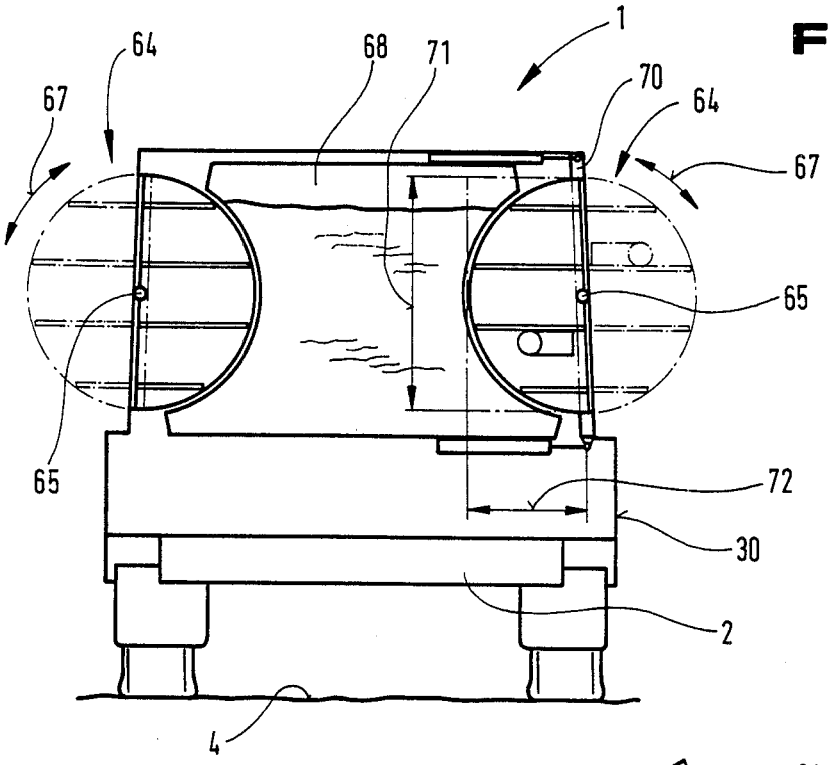
FIG. 6 is a partly sectional end view of a service vehicle having equipment modules pivotally mounted on axes extending parallel to the longitudinal axis of the vehicle.
Figure 7:
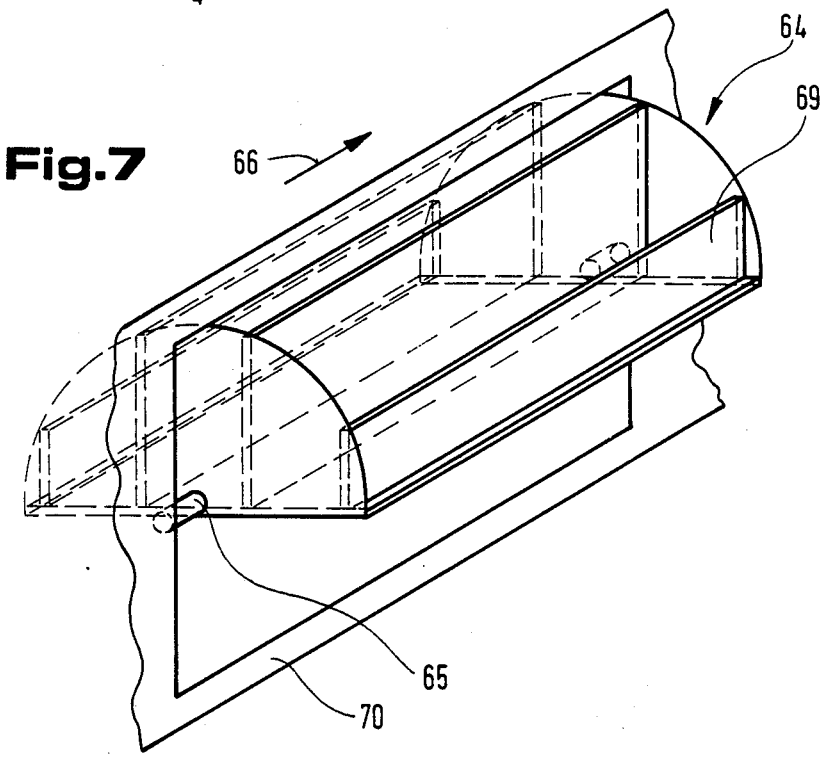
FIG. 7 is a fragmentary perspective view of part of the vehicle of FIG. 6, with an equipment module in a partially open condition.

A further embodiment of equipment modules 64 is illustrated in FIGS. 6 and 7. The equipment modules 64 have a part cylindrical profile similar to the modules of the embodiment of FIGS. 3 and 4 and pivot shaft 65 is arranged parallel to the longitudinal direction of the vehicle—arrow 66. The equipment modules 64 may be pivoted in the direction of arrows 67 from an idle or stowed position shown by solid lines into an extended dispensing position shown by dash-dotted lines. The extinguisher fluid tank 68 of the fire service vehicle 1 is provided with correspondingly concavely arcuately curved sidewalls to receive equipment modules in the idle or stowed position. As more clearly apparent from the illustration in FIG. 7, the shelf members 69 having a generally rectangular form are mounted longitudinally in spaced parallel relationship to facilitate the stowage of implements or items of equipment, such as extinguisher means, hoses in hose fittings, therebetween. The equipment modules 64 are rotatably installed in a carrying frame 70 by means of the central shaft 65. It is also possible to install each equipment module 64 in its own intermediate frame which may be pivoted or displaced laterally and vertically with respect to the carrying frame or the chassis frame 2, and especially with respect to the extinguisher fluid tank 68. The equipment modules 64 and their shelf panels 69 may thereby be placed at an advantageous height with respect to the wheel support surface 4 for access by personnel. It is also possible, for example, as denoted by dash-dotted lines in the region of the right-hand equipment module in FIG. 6, to construct the equipment module 64 in parallelepipedal profile with an approximately rectangular cross-section. It is then advantageous for the carrying frame 70 to be movable out beyond the lateral delimitation 30 of the fire service vehicle 1 by the difference between half the height 71 and a width 72 of the module cross-section, so that the equipment module may then be pivoted around the central longitudinal axis 65.

It is also possible to turn equipment modules formed in this manner around axes extending at right angles to the wheel support surface 4, the lateral movement path of such equipment modules then corresponding to the difference between half the length of the equipment module in the longitudinal direction of the vehicle—arrow 73, FIG. 3—and the width 72 of the equipment module.

Figure 8:
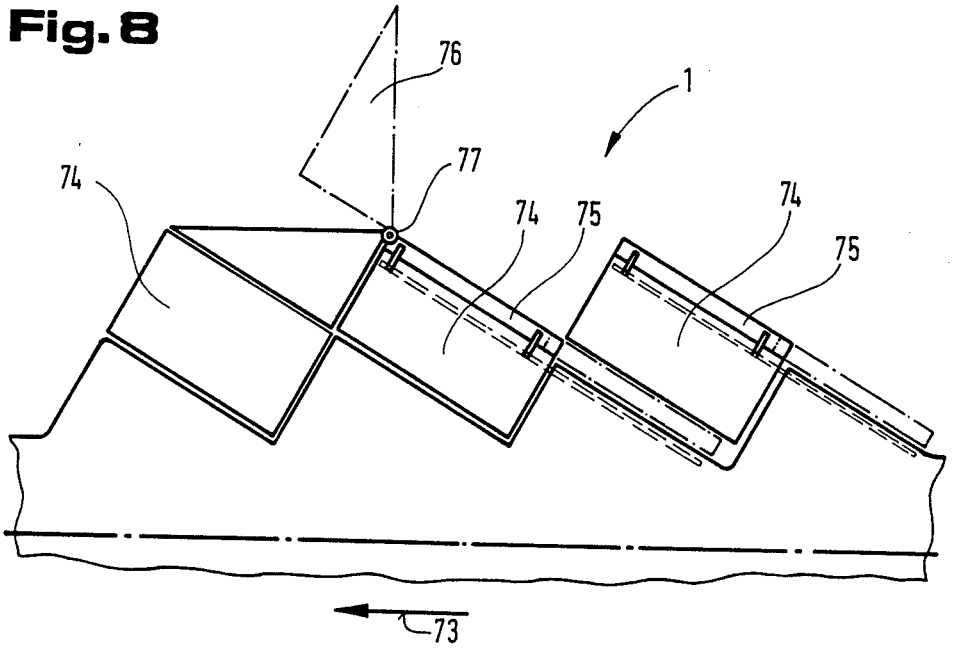
FIG. 8 is a fragmentary plan view of part of a vehicle having equipment modules of generally parallelepipedal form and staggered obliquely in relation to the longitudinal axis of the vehicle, the modules comprising displaceable sliding doors.

In the embodiment of FIG. 8, equipment modules 74 are set in a row obliquely in the direction of travel denoted by the arrow 73 and in the sides of the fire service vehicle 1. Sliding door elements 75 are provided for closing the outsides of the equipment modules 74. Thanks to the diagonally aligned arrangement of the equipment modules 74, the sliding door elements 75 may in each case be slid behind the rear longer side of an adjacent equipment module 74 following in the direction of travel, thereby allowing unrestricted access to the outsides of the equipment modules 74.

According to a modification of this embodiment, it is possible to use triangular pivotable equipment module elements 76 for closure of the equipment modules 74, which may be pivoted around a pivot shaft 77 mounted vertically at an apex of the triangular element at an outermost corner of an adjacent module 74, for opening the equipment modules 74 either manually, mechanically or fully automatically, from the position shown by solid lines—closing the forward equipment module 74—into the opened position shown by dash-dotted lines.

Figure 9:
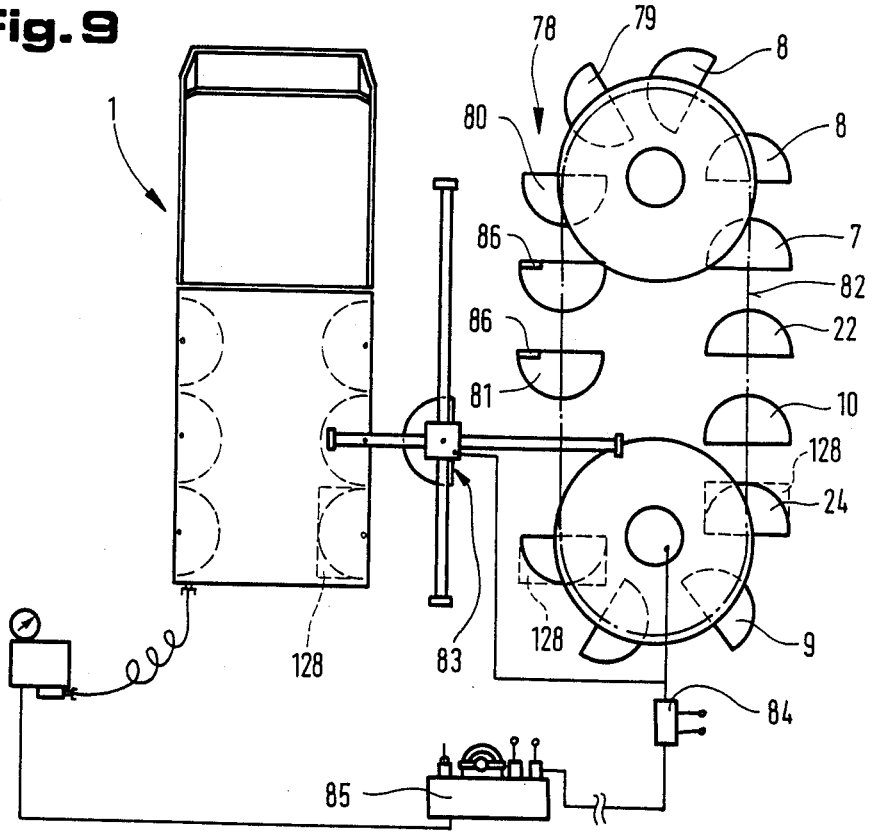
FIG. 9 is a plan view of a service vehicle comprising equipment modules according to the invention and a module repositioning system.

FIG. 9 shows a repositioning system 78 for equipment modules 7 to 10 and 22 to 24. This repositioning system 78 serves the purpose of loading fire service vehicles 1 with equipment modules 7 to 10 and 22 to 24, such as have been described with reference to FIGS. 1 to 3. To this end, it is possible to provide the vehicle with equipment adequate for the major part of possible uses. If, on the contrary, special conditions at the site of operation are known in advance or from observation of service personnel first to reach the site of operation, it is possible to install equipment modules 79,80,81 in the fire service vehicle 1 instead of the standard equipment modules. For example, these may be equipped with special outfits for use during earthquakes, requirements for heavy foam application, rescue on waterways, application to oil, antiradiation application, or the like. The different equipment modules 7 to 10, 22 to 24, 49, 50, 79 to 81 may for example be suspended from a circulating chain conveyor 82 which forms a magazine for a range of different equipment modules 7 to 10, 22 to 24, 79 to 81. A crane system 83 displaceable in the longitudinal and transverse directions in relation to the vehicle is arranged so that equipment modules may be extracted from the fire service vehicle 1 and suspended on the chain 82. In the same way, the required equipment modules are taken from the chain 82 and secured in the fire service vehicle 1. This repositioning of the equipment modules may be performed semi-automatically under manual control or fully automatically. Control units 84 may be provided in the region of the crane system 83 for this purpose.

It is also possible to install corresponding control units 85 at operational headquarters so that, upon receipt of an operational order, the equipment of the fire service vehicle may be preselected in accordance with the operation conditions described and the required equipment modules may be inserted into the fire service vehicle fully automatically by the crane system 83 and the repositioning system 78. Suitably the repositioning system 78 is so arranged to that the selection and loading of the equipment modules from the chain conveyor into the vehicle can be effected within the period normally required by service personnel to reach the fire service vehicles 1 so that the departure is not or only insignificantly delayed. The disadvantage caused by any slight delay in the departure is frequently obviated by the fact that the fire service vehicle 1 will be provided with the necessary items of equipment for dealing with the conditions of operations.

To allow for rapid and fully automatic selection of the equipment modules 7 to 10, 22 to 24, 79 to 81 provided with the appropriate equipment, the modules are suitably marked by code carriers 86 so that a rapid selection of the desired equipment modules may be performed in the region of the repositioning system 78. It is also possible to construct not only the equipment modules but also particular individual parts of the equipment in exchangeable manner and mark them with corresponding code carriers 86, so that only specific equipment items matching the different requirements may be exchanged or loaded into a module. It is to be understood that it is possible in the repositioning system described, to utilise parallelepipedal equipment modules 128—as shown by dash-dotted lines—instead of the equipment modules 79 and 80 having a cross-section in the form of a circular segment.

Figure 10:
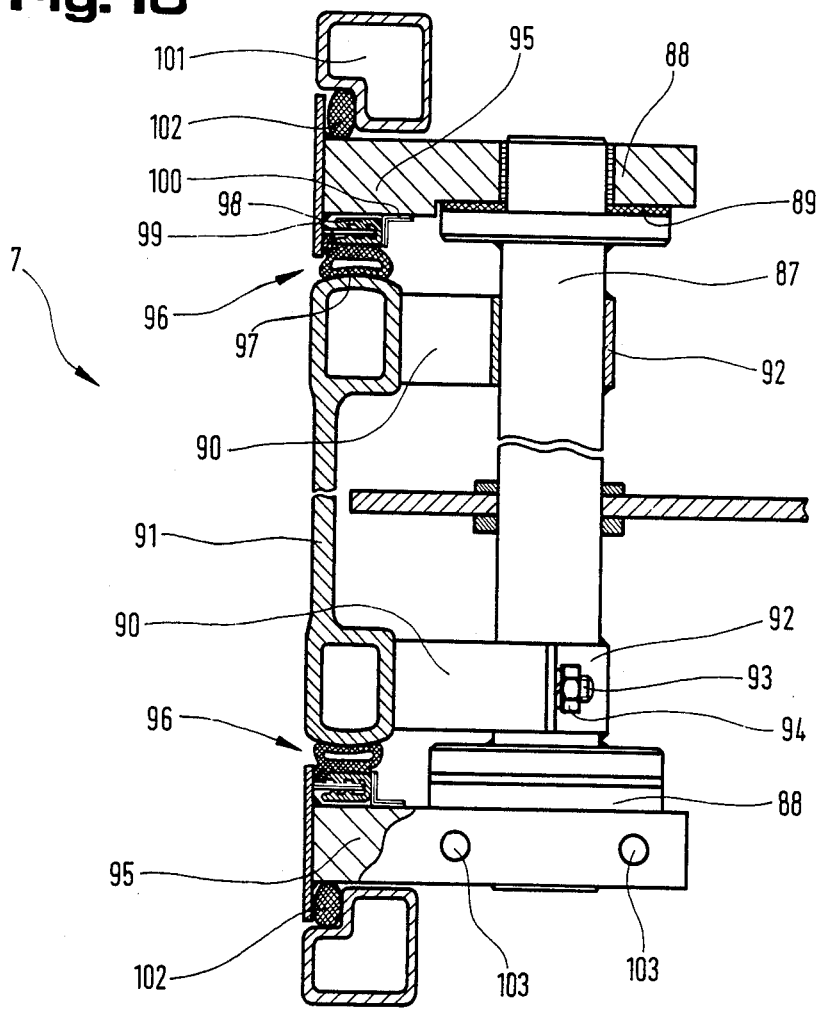
FIG. 10 is a partly sectional side view of an equipment module having sealing arrangements and taken on line X—X of FIG. 11.
Figure 11:
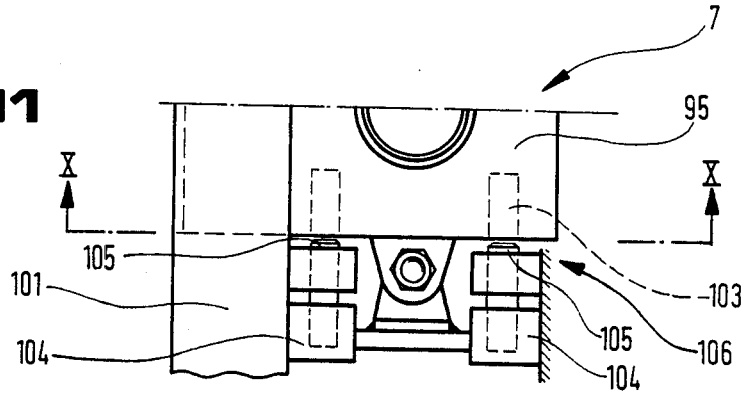
FIG. 11 is a fragmentary plan view of the equipment module of FIG. 10 and showing connecting elements between the module and a carrying frame.

Referring now to FIGS. 10 and 11, an equipment module 7 has a pivot shaft 87 which is journalled in two spaced bearer units 88. The bearer units 88 are coated with anti-friction facings 89. A cover plate 91 is secured by brackets 90 on the pivot shaft 87. Half shells 92 holding the pivot shaft 87 on the side distal from the cover plate 91 are welded to the pivot shaft 87, and are connected by bolts 93 and nuts 94 to brackets 90 extending on the opposite side of the pivot shaft. The spacing of the cover plate 91 from the pivot shaft 87 may be adjusted in the region of these joints between the brackets 90 and the half-shells 92 by the bolts 93 and nuts 94 and appropriate intermediate layers of packing shims or the like.

The bearer units 88 are secured in an intermediate frame 95 and the space between the intermediate frame 95 and the cover plate 91 is closed by sealing elements 96. These sealing elements 96 have a box section 97 which is secured by a gripping section 98 integrally formed therewith on a holder 99 projecting from the intermediate frame 95. To prevent the sealing element 96 from being pulled off the holder 99 upon opening the equipment module 7, a protective angle section 100 is provided. The intermediate frame 95 is equipped with projections directed against a carrying frame 101 and sealing elements 102 are similarly provided between the carrying frame 101 and the intermediate frame 95.

Tapered bores 103 are suitably provided in the intermediate frame 95 for locking the intermediate frame 95 in the carrying frame 101.

As shown in FIG. 11, displacing drives 104 are installed on the carrying frame 101, whereby locking studs 105—which may equally be of tapered form for better location and centering—are arranged for insertion into the bores 103. It is possible by actuating the displacing drives 104, which may be pneumatically operated piston-cylinder systems, to place the locking studs 105 into and out of engagement with the intermediate frame 95 and thus with the equipment module 7. These connecting elements 106 formed by the displacing drives 104, the locking studs 105 and the bores 103, allow for rapid interchange of the equipment modules 7, for example by means of a module repositioning system 78 depicted in FIG. 9.

It is also apparent from FIG. 11 that—instead of the connecting elements 106—the fastening of the bearer units 88 to the carrying frame may be rigid, for example by bolted connections with interposed resilient elements.

Figure 12:
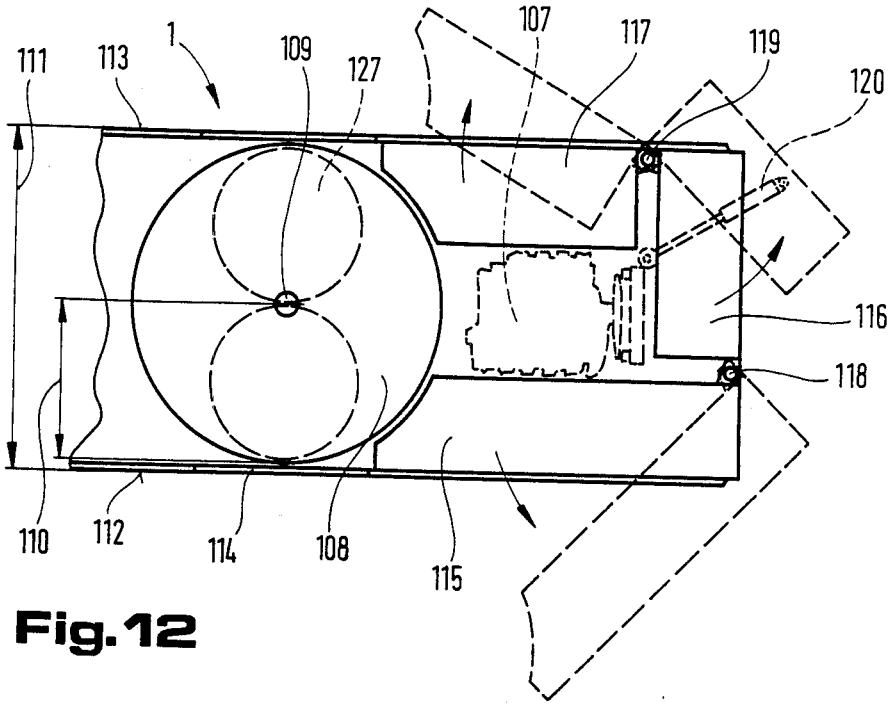
FIG. 12 is a fragmentary plan view of another embodiment of a service vehicle according to the invention and carrying equipment modules.

In the fragmentary plan view of FIG. 12, a driving engine 107 is situated approximately at the longitudinal centre line in the stern section of the vehicle. The driving engine is preceded by an equipment module 108 which is mounted for rotation about a vertical axis 109 and has a circular cross-section. A radius 110 of the equipment module 109 amounts to approximately half a distance 111 between the opposite sides 112,113 of the fire service vehicle 1. Access to the equipment module 108 is provided via "roll-top" panels 114 situated in the sidewalls of the fire service vehicle 1.

Approximately parallelepipedal equipment modules 115 to 117 are situated between the equipment module 108 and the stern of the fire service vehicle 1, between the vehicle sides 112 and 113 and the driving engine 107. The equipment module 115 is mounted for outward pivotal movement from the position shown by solid lines into the position shown by pecked lines about a pivotal axis 118 in the rear outer corner section of the equipment module 115. So that an optimum unobstructed access is possible to the driving engine 107 or any other system situated between these equipment modules, such as an emergency generator set, an extinguisher fluid pump, a tank or the like, an equipment module 116 extending parallel to the rear end side of the fire service vehicle is similarly arranged to be outwardly pivoted around a vertical axis 119 at an outer corner thereof and this vertical pivot axis 119 may also carry the equipment module 117. As a result access to the driving engine 107 is rendered possible from all sides without obstruction by outwardly pivoting the equipment modules 115 to 117 through 90°. The frame members of the chassis frame, which are situated under the equipment modules 115 to 117 may then be utilised as supporting or working surfaces for the service personnel. As shown diagrammatically in the case of the equipment module 116, this outward pivotal displacement of the equipment modules 115 to 117 may be assisted or caused by means of a piston-cylinder sytem 120. Suitably appropriate arrestor means, for immobilising the equipment modules 115 to 117 in their stowed and open positions are provided. To this end, use may be made of any optional securing devices such as locking bolts or pneumatically or hydraulically operated locking cylinders or the like.

Figure 13:
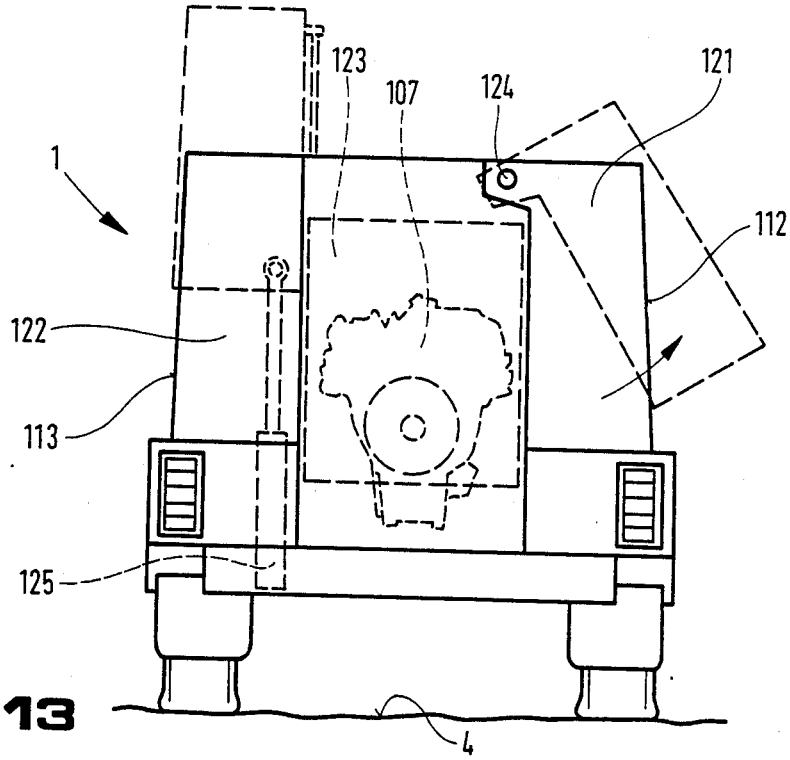
FIG. 13 is a diagrammatic end view of a service vehicle according to the invention and carrying equipment modules of a further construction and arrangement.

In the embodiment of FIG. 13, equipment modules 121 and 122 are situated between sides 112 and 113 of the fire service vehicle 1 and a driving engine 107 is situated approximately at the centre line of the vehicle. To allow for access to the driving engine 107 or to an equipment module 123 installed in its stead or forwardly thereof—as shown by dash-dotted lines—the equipment module 121 is arranged to be pivoted away in lateral and upward direction around an upper horizontal axis 124.

Another means for allowing access to the driving engine 107 or the equipment module 123 is illustrated at the side 113 of the fire service vehicle 1 where an equipment module 122 is upwardly displaced at right angles to the wheel support surface 4, for example by means of a piston-cylinder drive 125.

It is possible within the scope of the invention for the arrestor devices for the individual displaceable equipment modules as well as the displacing drives to be operated manually, semi-automatically or fully automatically. It is also possible to utilise the displaceability of the equipment modules for improved access to equipment elements or assemblies or the like arranged therebetween, to facilitate the removal thereof.

It is also possible to arrange—as shown in FIG. 12 in the area of the equipment module 108 in diagrammatical form by pecked lines—two adjacent upright cylindrical rotatable modules 126 and 127 with their axes situated vertically in a plane extending at right angles to the direction of travel. To this end, a radius of the equipment modules 126 and 127 corresponds approximately to a quarter of the distance 111 between the two sides of the vehicle, or to half of the radius 110.

Whilst the invention and many of its attendant advantages will be understood from the foregoing description it will be apparent that various changes can be made in the construction and arrangement of parts described without departing from the spirit and scope of the invention or sacrificing all of its material advantages.

What is claimed is:

1. A service vehicle comprising
(a) a chassis frame carried by wheels for support on a surface,
(b) a driver's cab mounted on the chassis frame,
(c) two side walls mounted on the chassis frame and defining an equipment compartment comprising
(1) at least one equipment module arranged along each one of the side walls and holding service equipment, and
(d) means for pivoting each one of the equipment modules about a respective axis arranged at the side wall along which the equipment module is arranged between a first position wherein the equipment module is located substantially within the equipment compartment and the service equipment is inaccessible from the outside and a second position wherein the equipment module is located substantially outside the equipment compartment and the service equipment is accessible from the outside; and
(e) a complementary structure within the equipment compartment and including recesses mating with the modules in the first position to confine the service equipment.

2. The service vehicle of claim 1, wherein each one of the pivoting axes extends substantially perpendicularly to the support surface.

3. The service vehicle of claim 2, wherein a horizontal cross section of the equipment modules has the shape of a segment of a circle delimited by a chord and the segment has an arc height exceeding the radius of the circle.

4. The service vehicle of claim 3, wherein the pivoting means comprises a pivot shaft for each one of the equipment modules, a plurality of said equipment modules being arranged at each side wall and the axes of the pivot shafts at each side wall extending in a common plane.

5. The service vehicle of claim 3, further comprising a cover plate extending along the chord and closing each equuipment module, and a plurality of shelf members spaced along the axis of each equipment module, the shelf members having the same shape as the cross sections of the equipment modules.

6. The service vehicle of claim 3, wherein the axes of the equipment modules at each side wall are spaced from said side wall a distance corresponding to the difference between the height of the arc of the circular segment and half the diameter.

7. The service vehicle of claim 3, further comprising a carrier frame carrying each pivot axis at each side wall.

8. The service vehicle of claim 7, wherein said complementary structure is a fire extinguisher fluid tank mounted centrally between the side walls, and the tank having side walls facing the equipment modules, the tank side walls defining said recesses of a cross section having the shape of a circular segment, the radius of the circular segment of the recess cross sections exceeding that of the circular segment of the equipment module cross sections.

9. The service vehicle of claim 1, further comprising a driver's seat in the driver's cab and an additional equipment module mounted in the driver's cab behind the driver's seat.

* * * * *